US007603780B2

(12) United States Patent
Oikarinen et al.

(10) Patent No.: US 7,603,780 B2
(45) Date of Patent: Oct. 20, 2009

(54) MULTI-PURPOSE TOOL

(76) Inventors: George L. Oikarinen, 54691 Oikarinen Rd., Calumet, MI (US) 49913; Scott F. Zenner, P.O. Box 191, Houghton, MI (US) 49931

( * ) Notice: Subject to any disclaimer, the term of this patent is extended or adjusted under 35 U.S.C. 154(b) by 0 days.

(21) Appl. No.: 12/167,669

(22) Filed: Jul. 3, 2008

(65) Prior Publication Data

US 2008/0282548 A1 Nov. 20, 2008

Related U.S. Application Data

(63) Continuation-in-part of application No. 11/355,528, filed on Feb. 16, 2006, now abandoned.

(51) Int. Cl.
*A47L 13/02* (2006.01)

(52) U.S. Cl. ..... 30/172; 30/167; 30/169; 30/340; 15/144.2; 15/236.01

(58) Field of Classification Search ..... 30/167, 30/167.1, 168, 169, 171, 172, 340, 342, 344; 15/144.1, 144.2, 236.01
See application file for complete search history.

(56) References Cited

U.S. PATENT DOCUMENTS

| | | | | | |
|---|---|---|---|---|---|
| 963,630 | A | * | 7/1910 | McLean | 30/171 |
| 1,327,155 | A | | 1/1920 | Gottschalk | |
| 2,215,216 | A | | 9/1940 | Gits et al. | |
| 2,362,466 | A | * | 11/1944 | Carter | 297/6 |
| 2,700,783 | A | * | 2/1955 | Parker et al. | 15/79.1 |
| 2,705,644 | A | * | 4/1955 | Stelzer | 280/654 |
| 2,737,673 | A | * | 3/1956 | Parker et al. | 15/79.1 |
| 2,769,236 | A | | 11/1956 | Phillips et al. | |
| 3,358,313 | A | * | 12/1967 | Grimes, Sr. | 15/231 |
| 3,726,010 | A | | 4/1973 | Yokoyama | |
| 3,893,238 | A | | 7/1975 | Scholl | |
| 3,991,467 | A | | 11/1976 | Yokoyama | |
| 4,086,699 | A | | 5/1978 | Olkkola | |
| 4,455,705 | A | * | 6/1984 | Graham | 15/121 |
| 5,203,086 | A | | 4/1993 | Dann | |
| 5,813,295 | A | | 9/1998 | Jensen, Jr. | |
| 6,568,087 | B1 | | 5/2003 | Gringer | |
| 6,732,395 | B2 | | 5/2004 | Gringer | |
| 6,745,478 | B2 | | 6/2004 | DeLillo | |
| 2006/0037199 | A1 | * | 2/2006 | Alpert | 30/169 |

* cited by examiner

*Primary Examiner*—Hwei-Siu C Payer
(74) *Attorney, Agent, or Firm*—Reising Ethington P.C.

(57) ABSTRACT

In one form, a tool may include a handle, a head having a planar lower surface and at least one side face inclined at an acute included angle relative to the lower surface, and a mount interconnecting the handle and head. The mount may have at least one connection feature permitting pivoted movement of the handle relative to the head to permit changes in the angle of the handle relative to the head.

9 Claims, 4 Drawing Sheets

Fig. 5
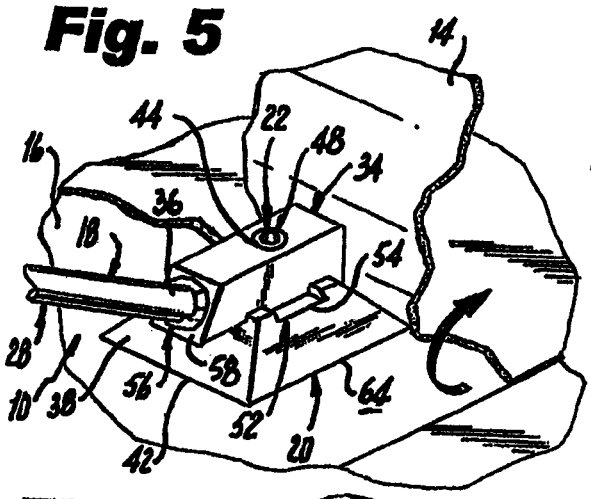
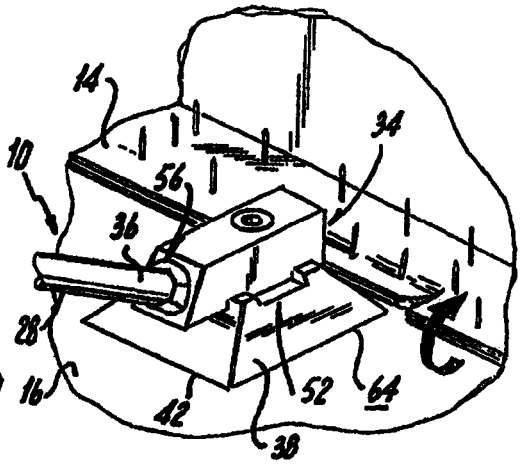
Fig. 6
Fig. 7
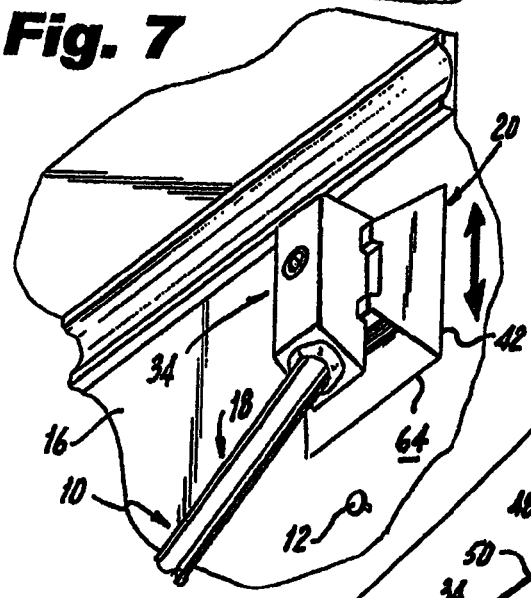
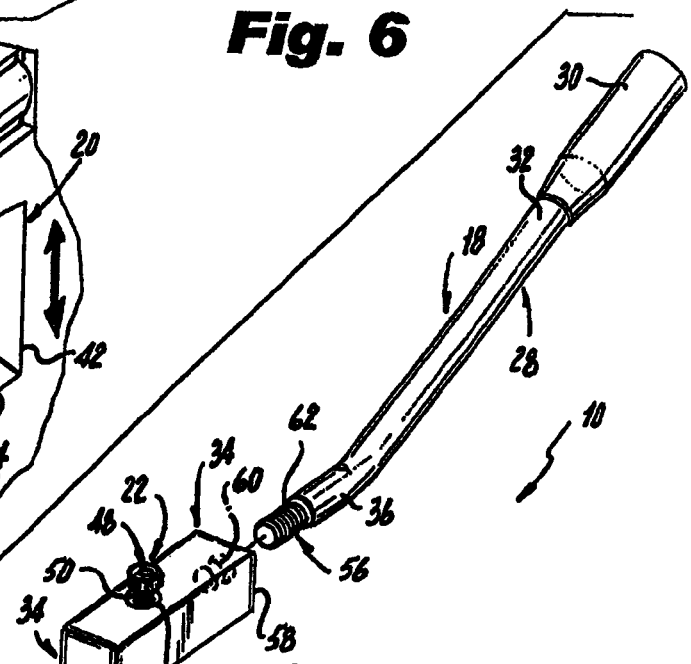
Fig. 8
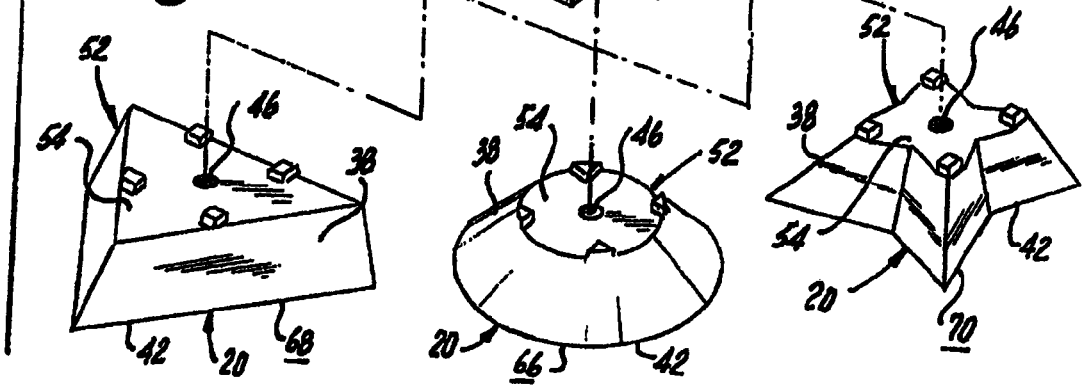

MULTI-PURPOSE TOOL

REFERENCE TO CO-PENDING APPLICATION

This application is a Continuation-in-Part of, and incorporates by reference in its entirety, U.S. application Ser. No. 11/355,528, filed Feb. 16, 2006, now abandoned.

FIELD OF THE INVENTION

The present invention relates generally to a tool and more particularly to an implement or tool for scraping and other tasks.

BACKGROUND OF THE INVENTION

Carpets may be held down with tack strips which are themselves nailed to a floor or sub-floor covered by the carpet. When the carpet is removed, the tack strips remain in place and their removal can be a difficult, labor intensive task that takes significant time. Typically, not only must the strips themselves be completely removed, but the nails used to secure the strips to the floor must be dealt with to provide a surface upon which a new floor covering can be provided. Beyond tack strips, floors and other surfaces may require removal of debris, nails, glue, or anything else. For example, it may be desirable to break-up and remove tiles on a floor or wall, linoleum flooring, glue or other adhesives on a floor or wall, or the like. Individually and manually removing such debris or items can be time consuming and difficult. Beyond scraping, oftentimes tamping or flattening a surface is desirable either separately or in combination with some scraping.

SUMMARY OF THE DISCLOSURE

In one form, a tool may include a handle, a head having a planar lower surface and at least one side face inclined at an acute included angle relative to the lower surface, and a mount interconnecting the handle and head. The mount may have at least one connection feature permitting pivoted movement of the handle relative to the head to permit changes in the angle of the handle relative to the head.

In one form, a tool may include a handle, a head, and a mount. The head may have a weight in a range between 1 and 20 pounds, a cutting edge extending completely around a lower perimeter of the cutting head, a planar lower surface adapted to be slid along a surface to be scraped, a seat formed in a surface of the head opposite the flat bottom surface, and an opening extending into the seat to facilitate connecting the handle to the head. The mount may be disposed on the seat and including a connector disposed in the opening and connecting the mount to the head, wherein the handle is connected to the mount and the connector does not protrude from the flat bottom surface so that the cutting head can be slid with its flat bottom surface flush with the surface to be scraped.

BRIEF DESCRIPTION OF THE DRAWINGS

The following detailed description of preferred embodiments and best mode will be set forth with reference to the accompanying drawings, in which:

FIG. 5 is a diagrammatic perspective view of the tool, with parts broken away, being utilized to scrape off a finish;

FIG. 6 is a diagrammatic perspective view of the tool, with parts broken away, being utilized to remove a tackless carpet strip;

FIG. 7 is a diagrammatic perspective view of the tool, with parts broken away, being utilized as a general purpose scraping tool;

FIG. 8 is a diagrammatic exploded perspective view of the tool, illustrating other alternatively shaped cutting heads;

DETAILED DESCRIPTION OF PREFERRED EMBODIMENTS

Figure 1:
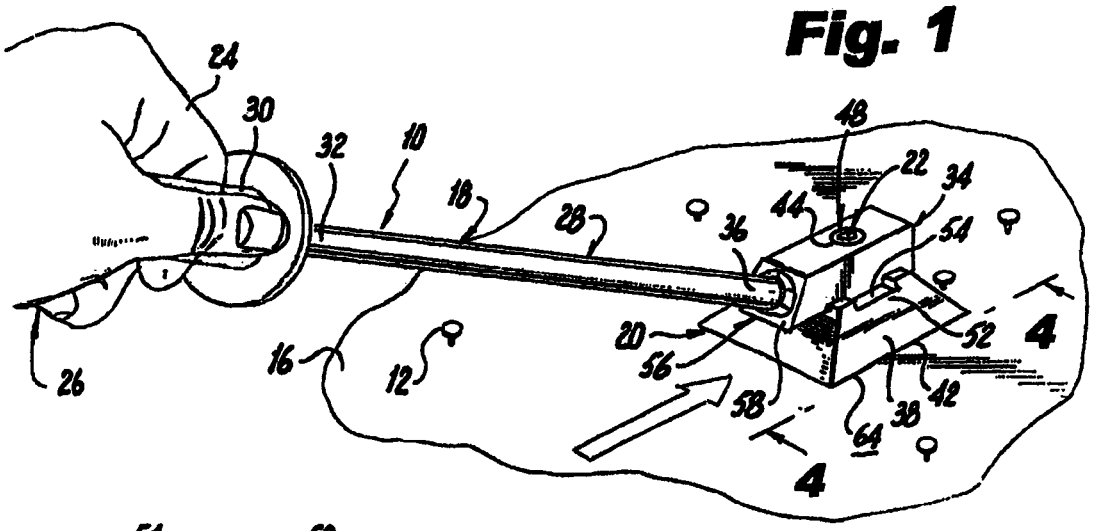
FIG. 1 is a diagrammatic perspective view showing a tool in use.
Figure 3:
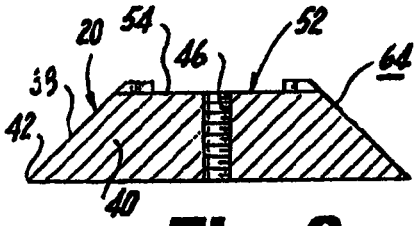
FIG. 3 is an enlarged diagrammatic cross sectional view taken on line 3-3 in FIG. 2 of the cutting head.
Figure 2:
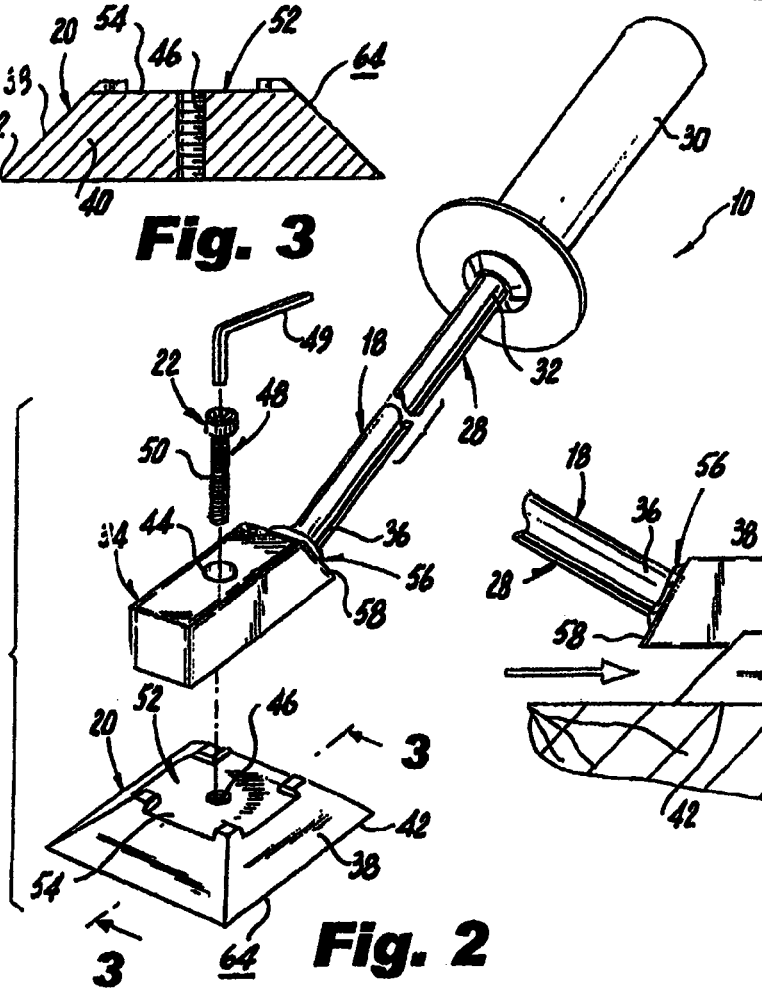
FIG. 2 is a diagrammatic exploded perspective view, with parts broken away, of the tool of FIG. 1.
Figure 4:
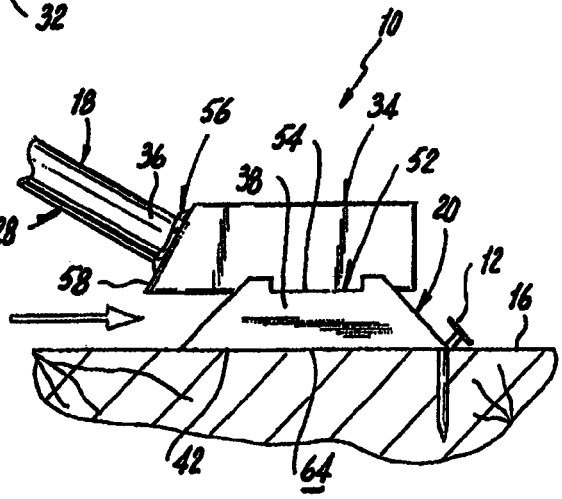
FIG. 4 is an enlarged diagrammatic cross sectional view, with parts broken away, taken on line 4-4 in FIG. 1, showing the tool in use slicing off some nail heads.

Referring now to FIGS. 1 through 8, in which like numerals indicate like parts, the present invention is a tool 10 for removing nail heads 12 and other debris 14, such as a finish or a tackless carpet strip from a surface 16. The tool 10 comprises a handle 18, a weighted cutting head 20 and a mount or other mechanism 22 for attaching the handle 18 to the weighted cutting head 20. When a hand 24 of a user 26 grasps the handle 18 and the weighted cutting head 20 is moved upon the surface 16, sufficient momentum will be provided to easily scrape away the nail heads 12 and the other debris 14 with little effort.

The handle 18 includes a shaft 28 and a grip 30 on a first end 32 of the shaft 28, wherein the grip 30 is grasped by the hand 24 of the user 26. A flat-bottom base 34 or adapter may be provided on a second end 36 of the shaft 28. The weighted cutting head 20 may include a body 38 fabricated out of a heavy metal mass 40, having an outwardly angular sharp cutting edge 42 about a lower perimeter of the body 38 and a planar lower surface. A head typically may be fabricated out of harden steel and have a weight in the range between of 0.5 to 20 pounds depending on the nature of the work and the preference of the user. The mount or attaching mechanism 22 may consist of the flat-bottom base 34 having a central aperture 44 therethrough. The weighted cutting head 20 has a central threaded aperture 46 therethrough. A bolt 48 is provided having a threaded shank 50 that extends through the central aperture 44 in the flat-bottom base 34 and into the central threaded aperture 46 in the weighted cutting head 20. The bolt 48 will retain the flat-bottom base 34 onto the weighted cutting head 20. A wrench 49 is provided for loosening and tightening the bolt 48 when it is desired to exchange weighted cutting heads 20.

The body 38 of the weighted cutting head 20 may have a top channel 52 sized to receive the flat-bottom base 34 thereon. The top channel 52 will maintain the flat-bottom base 34 to the body 38 of the weighted cutting head 20 in a stabilized manner when the flat-bottom base 34 is attached thereto. The top channel 52 in the body 38 of the weighted cutting head 20 may be a cross-shaped seat 54, so that the flat-bottom base 34 can be attached to the body 38 of the weighted cutting head 20 in any one of four different positions.

The tool 10 may further include a structure 56 for securing the second end 36 of the shaft 28 to a first side 58 of the flat-bottom base 34, so that the shaft 28 will extend upwardly at an angle from the first side 58 of the flat-bottom base 34. The securing structure 56, as shown in FIGS. 1, 2 and 4 through 7, is a weld 58 formed between the second end 36 of the shaft 28 and the first side 58 of the flat-bottom base 34, in which the first side 58 of the flat-bottom base 34 is angled inwardly.

The securing structure 56, as shown in FIG. 8, consists of the first side 58 of the flat-bottom base 34 having a threaded aperture 60 therein. The shaft 28 is bent near the second end 36 with the second end 36 having a threaded lug 62 thereon. The threaded lug 62 on the second end 36 of the shaft 28 will thread into the threaded aperture 60 in the first side 58 of the flat-bottom base 34.

As shown in FIGS. 1 through 7, the body 38 of the weighted cutting head 20 is a truncated pyramid shaped member 64. As shown in FIG. 8, the body 38 of the weighted cutting head 20 can also be a truncated cone shaped member 66, a truncated trihedron shaped member 68 or a truncated four pointed star shaped member 70. Other shapes may be utilized.

The tool 100 in FIGS. 9-12 may include a similar handle 102 as the handle 18 which may be of any desired length, and a head 104 that may be constructed similarly to the previously described cutting head 20, including the many variations in size, shape and weight. In this tool 100, the handle 102 is movably or pivotably connected to the head 104 to facilitate operation of the tool in a wide range of orientations or operating positions.

The handle 102 may include a threaded end or may be connected, such as by a weld, adhesive, press fit, detent or latch, mating tapered walls, or other method, to an adapter 108 or other component which may be threaded to facilitate releasable connection of the handle to the head 104. Of course, the handle 102 could also be permanently connected to the head 104, or releasably connected to the head 104 in some other manner than mating threads, for example, by spring loaded detents, hook or latch, etc. Depending on the weight of the head 104 and its intended uses, a suitably robust connection between the handle and head should be chosen. In the implementation shown, a mount 110 interconnects the handle 102 and head 104, and has at least one connection feature permitting pivoted movement of the handle relative to the head to permit adjustment of the angle of the handle relative to the head.

Figures 11, 12:
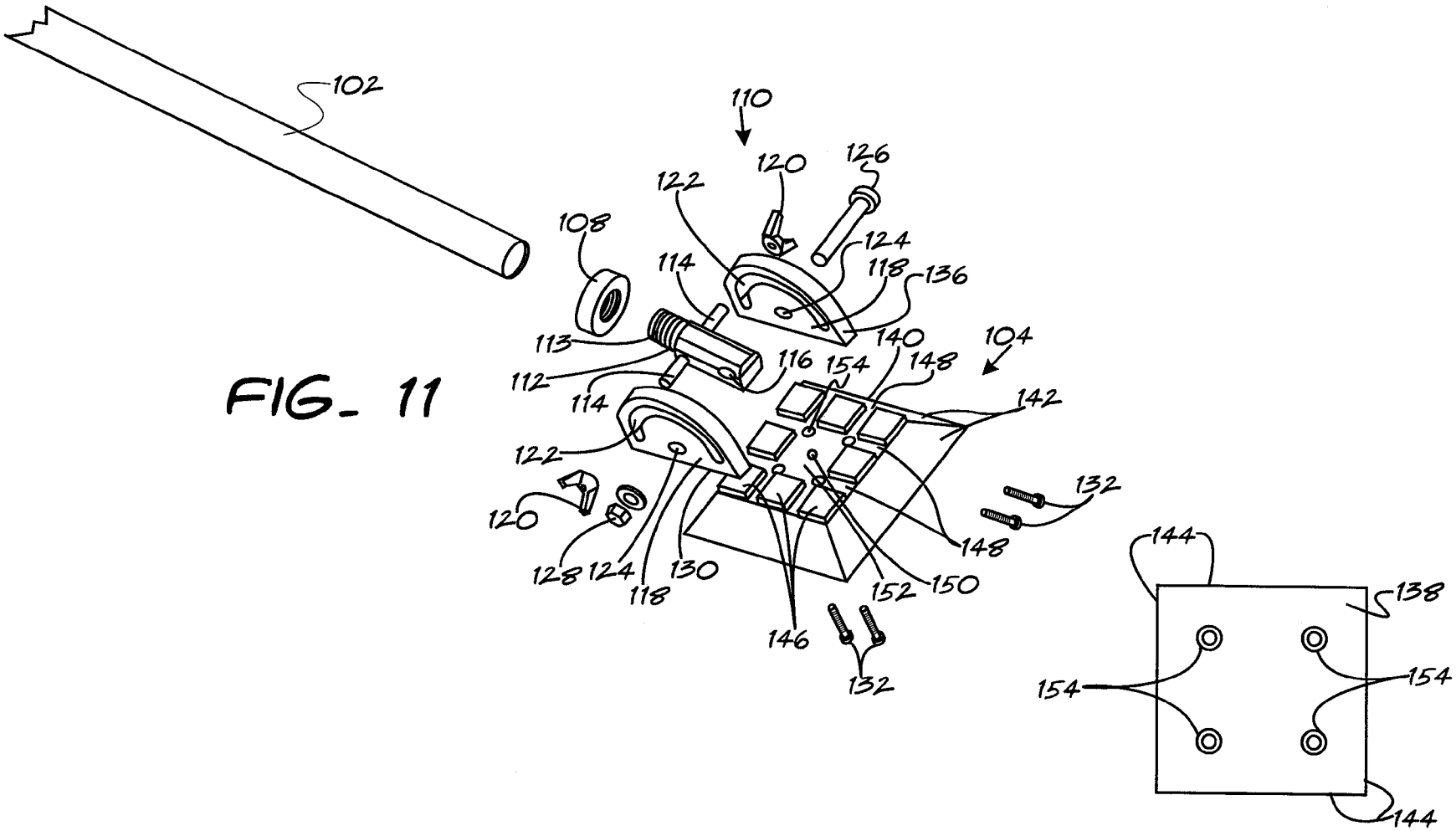
FIG. 11 is an exploded perspective view of the tool showing various components of the tool.
FIG. 12 is a bottom view of a head of the tool.

As best shown in FIG. 11, the handle 102 or mount 110 may include a base 112 that facilitates connecting together the handle 102 and head 104. The base 112 may include a threaded end 113 adapted to releasably receive the handle 102 and its adapter 108. The base 112 may also include one or more outwardly extending posts 114 which, in the example shown, extend generally perpendicularly from the base although other angles may be utilized. In this manner, each post may be coupled to the handle 102 for co-movement with the handle. Each post 114 may be generally cylindrical and include a threaded end spaced from the main body of the base 112. The posts 114 could be a single body or threaded shank. The base 112 may include a hole 116 which may be located adjacent to the end opposite the threaded end 113. The base body and posts may be formed from metal or any other material of suitable strength and impact resistance for the intended use of the tool.

The mount 110 may also include one or more connection features that may mate with the base 112 and may be arranged to be connected to or carried by the head 104. The connection features in the implementation shown may include at least part of the base 112, two brackets 118, and connectors or fasteners 120 to retain the position of the base posts 114 when desired. One bracket 118 may be provided on each of a pair of opposed sides of the base 112.

The mount 110 may include a position control feature that facilitates control of and may selectively limit or prevent movement of the handle 102 relative to the head 104. In one implementation, the position control feature includes the posts 114 and a slot 122 in one or each bracket 118 arranged to slidably receive at least part of a post 114. In the implementation shown, each slot 122 is arcuate and spans an angle of more than 90 degrees, and may span an angle of at least 160 and up to about 180 degrees such that the base 112 (and hence, the handle) may lie generally flat against the head 104 in each of two opposed directions, and may be oriented at any angle therebetween. In one form, a threaded portion of each post 114 extends through an adjacent slot 122 and outwardly from the bracket 118 to receive a fastener 120. The fasteners 120 may be carried by the posts 114 and moveable from a position permitting movement of the posts 114 relative to the bracket 118 to a position at least substantially restricting movement of the post 114 relative to the bracket 118 to maintain the position of the post relative to the bracket. In one form, the fasteners are wingnuts threaded onto the posts 114 and moveable between a loosened or removed position and a tightened position.

Each bracket 118 may also include a hole 124 with the holes 124 adapted to be aligned with the base hole 116 to receive a bolt 126, pivot pin or other connection member therethrough. The bolt 126 or other connection member acts as a pivot spaced from the slots 122 and posts 114, and about which the handle 102 pivots relative to the head 104. The bolt 126 also retains the handle 102 on the head 104 even when the handle 102 is being pivoted relative to the head 104. The brackets 118 and base 112 may be trapped between a head of the bolt 126 and a nut 128 on the bolt. As one alternative, the bolt 126 or a pivot pin may be shaped like ⊥ with a perpendicular and threaded shank on which the handle could be threaded to, for example, eliminate the base 112. Each bracket 118 may include a lower face 130 adapted to be disposed adjacent to the head 104 when the tool 100 is assembled. The lower face 130 of each bracket 118 may include one or more blind, threaded bores adapted to receive an end of a bolt 132 extending through the head 104 to attach the brackets 118 to the head 104. In this way, the brackets 118 can be removed from the head 104 to facilitate repair or replacement of the head 104, or to change the orientation of the brackets 118 on the head 104 as will be described below. The upper surface 136 of the brackets 118 may also be arcuate. And the brackets 118 may be close enough in assembly of the tool 100 so that the end of the handle (or the adapter 108 or other component, if provided) rides closely over the upper surface 136 of one or both brackets 118. The brackets 118 may also be formed without any slots 122 or other openings. In one form, the position control feature may include the upper surface 136 of the brackets 118 and the angle of the handle 102 relative to the head 104 can be maintained (if desired) such as by threading the handle 102 onto the base 112 until the handle 102 or adapter 108 or other component bears on the brackets 118 to frictionally retain the handle position. To improve the retention, the adapter 108 may include a softer surface or material or other arrangement that provides greater friction than a metal-to-metal engagement.

The head 104 may include a planar lower surface 138, an upper surface 140 constructed to receive the mount 110, and one or more side faces 142 extending around at least a portion of and up to all of the periphery of and sharing an edge 144 with the lower surface 138 of head 104, with a portion of each edge or side face 142 disposed generally at or adjacent to the lower surface 138. In the implementation shown, the head 104 has four side faces 142 inclined at an acute included angle relative to the lower surface 138 to define a truncated pyramid shaped head with an upper surface 140 of lesser surface area than the lower surface 138 and side faces 142 that may be at least one-quarter inch in length between the lower surface and upper surface. In one implementation, the lower surface 138 may be about 2 to 8 inches on a side or otherwise have a surface area of about 4 inches square to 64 inches square and the side faces 142 may have a height of between about ¼ to 3 inches. The head 104 could have any desired size or shape, providing any number of faces 142 (including one or more than one face) which may be linear, arcuate or otherwise arranged. In a presently preferred form, the head may weigh between 1 and 20 pounds. Of course, other weights are possible.

In the implementation shown, the upper surface 140 includes eight supports 146 defining one or more seats. Each seat in this embodiment may have two pairs of parallel tracks 148, with the pairs of tracks 148 being perpendicular to each other and evenly spaced relative to an axis 150 including a center of mass of the head in a generally tic-tac-toe grid layout. In this manner, the brackets 118 may be arranged parallel to each other and in two orientations with one orientation at 90 degrees to the other. The supports 146 may lie closely adjacent to the brackets 118 to prevent twisting or skewing of the brackets. The tic-tac-toe grid layout provides supports 146 on both sides of each bracket 118. The head 104 and/or mount 110 may be constructed to provide other angles and numbers of orientations of the handle 102 and mount 110 relative to the head 104, and may not provide any supports 146 or may provide other side supports 146 as desired. A central space 152 between the supports 146 may provide clearance for pivoted movement of the base 112 while maintaining the base relatively closely spaced to the head 104. The base 112 and/or brackets 118 may be designed to permit pivoting of the base 112 without the space 152. One or more fasteners 132 may be used to connect the brackets 118 to the head 104. As shown, two fasteners 132 are used to connect each bracket 118 to the head, and the fasteners 132 extend through counterbored holes 154 (FIG. 12) formed through the head 104. The fasteners 132 are inserted through the lower surface 138 of the head 104 and extend through the top surface 140 so that they may be threaded into the brackets 118. The counterbores 154 ensure the fasteners 132 do not protrude below the planar lower surface 138 of the head 104.

With the base 112 positioned between the brackets 118 and the brackets connected to or otherwise carried by the head 104, the handle 102 can be attached to the base and the wingnuts 120 can be loosened to permit the angle of the handle 102 relative to the head 104 to be adjusted. If desired, the wingnuts 120 can be tightened to retain a desired position of the handle 102, or the wingnuts can be left loose so the handle can pivot relative to the head 104 in use. In use as a scraper, a user applies force generally along the axis of the handle 102 to slide the head 104 forward and backward along a surface to be scraped (of course, the head could be moved at any angle in addition to forward and backward). The trailing or backward facing side face 142 could be made the frontward or forward facing side face by pivoting the handle 102 sufficiently relative to the head 104. The left or right side faces 142 in one orientation could be made the forward and rearward facing side faces in another orientation by mounting the brackets 118 in the other or perpendicular seat or tracks. Accordingly, should a forward facing side face 142 be the primary face used in a particular application, the tool 100 can be oriented such that any of the side faces 142 can be made the forward facing side face to extend the life of the tool and/or reduce the necessity for repair or refurbishment of the head 104.

Figure 10:
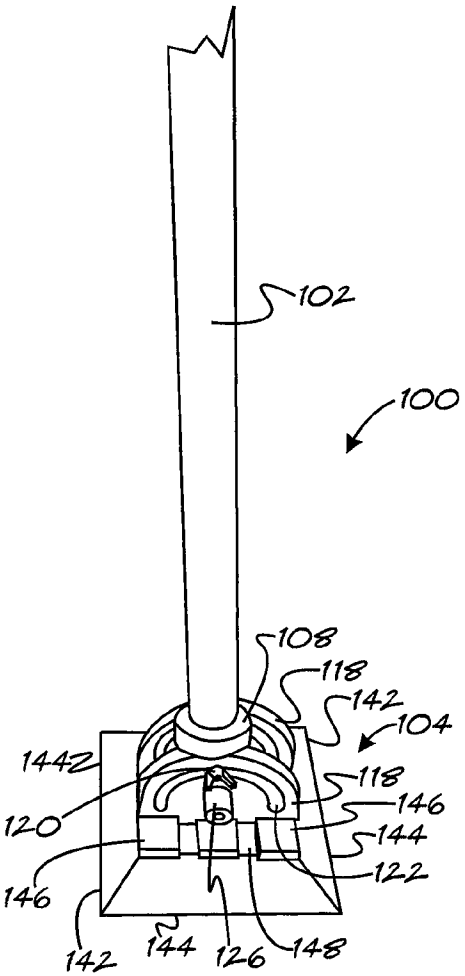
FIG. 10 is a perspective view of the tool shown in an alternate operating position.
Figure 9:
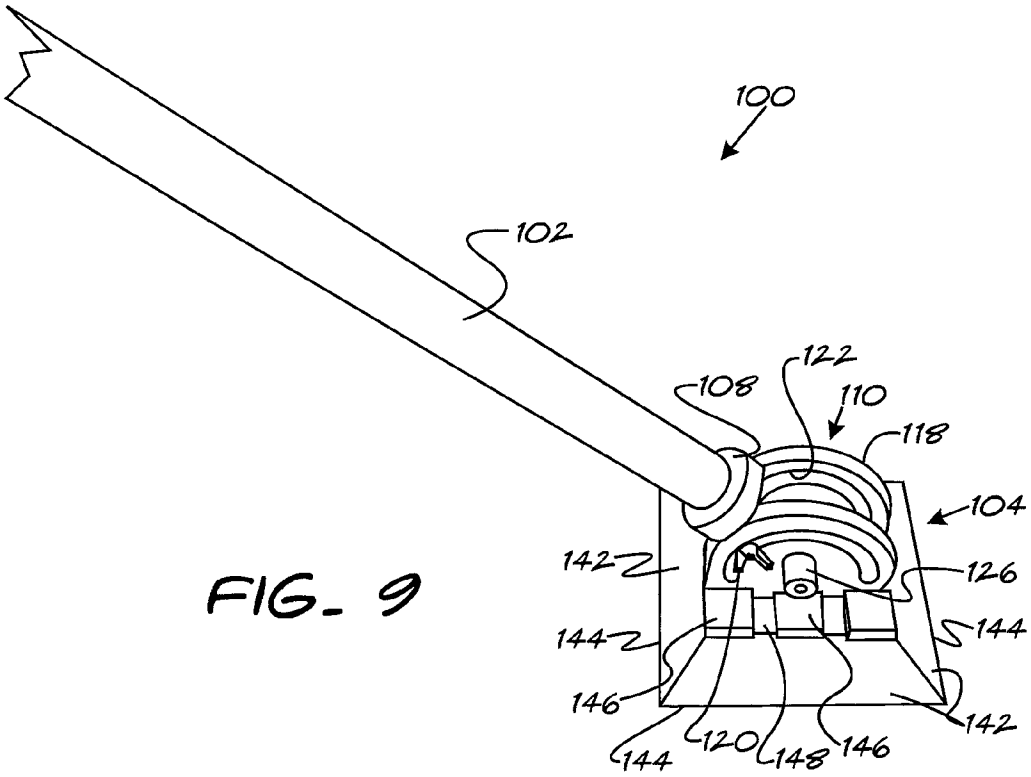
FIG. 9 is a perspective view of another implementation of a tool.

Further, as best shown in FIG. 10, the handle 102 can be oriented perpendicular to the lower surface 138 so that the head 104 can be efficiently raised and lowered to compact or tamp a floor/ground with the lower surface 138, drive nails flush into the floor/ground, crush or break-up debris or other things on the floor/ground, etc. Of course, the tool can be used in a wide variety of other applications such as in demolition of drywall, plaster and other walls or surfaces such as by swinging the head into a surface, or as a pick axe or hoe by way of examples without limitation. The pivoted handle 102 can permit more comfortable use of the tool 100 in a wide range of applications and orientations, by persons of different height or strength, and can more efficiently direct force to the head, for example, by controlling the direction of the force relative to the center of mass of the head. In one form, the fasteners 132 connecting the brackets 118 to the head 104 may be spaced generally equidistant from the center of mass of the head 104, and the bolt 126 connecting the base 112 to the brackets 118 may be located in a plane that includes the center of mass of the head 104, so that the handle 102 pivots generally about the center of mass of the head. Also, if the handle 102 or adapter 108 bears on the brackets 118, the force can be applied to the brackets behind (relative to the intended direction of movement) the head's center of nuts to facilitate sliding the head 104 when the tool is used in that manner.

It will be understood that each of the elements described above, or two or more together, may also find a useful application in other types of constructions differing from the types described above.

The various embodiments of a tool disclosed herein, that has many uses such as removing nail heads and other debris from a surface, demolition tasks, tamping, etc., are not limited to the details shown, since it will be understood that various omissions, modifications, substitutions and changes in the forms and details of the devices illustrated and their operation can be made by those skilled in the art without departing in any way from the spirit and scope of the present disclosure.

While the forms of the tool herein disclosed constitute presently preferred embodiments, many others are possible. For example, while an arcuate and continuous slot is shown in each bracket to permit the handle to be oriented at any angle within the slot, discrete handle positions could be provided by a different position control feature. This could be accomplished, for example, by providing spring-biased detents on the base and suitable recesses or holes to receive the detents in the various positions along the brackets. And other pivot or rotational features or arrangements could also be used to connect the handle 102 to the head 104, for example, a trunnion-type mount, a spherical ball joint, a cylindrical pin transverse to and connected to the handle and rotatably carried by the head, etc. Also, the base could be removed and the handle could itself be attached to the brackets by the bolt, and the handle could be provided with the outwardly extending posts such as by extending a pin through a hole formed perpendicular to the axis of the handle, and or as noted previously, the slots 122 and posts 114 could be eliminated. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A tool, comprising:

a handle;

a head, having:

a weight in a range between 1 and 20 pounds, an edge extending completely around a lower perimeter of the head, a planar lower surface adapted to be slid along a surface to be scraped, and a seat of the head opposite the lower surface, an opening extending into the seat to facilitate connecting the handle to the head; and a mount disposed on the seat and including a connector disposed in the opening and connecting the mount to the head, wherein the handle is connected to the mount and the connector does not protrude from the lower surface so that the head can be slid with its lower surface flush with the surface on which it is moved;

wherein the mount includes a pivot which permits the handle to pivot relative to the head and a position control feature which selectively limits or prevents movement of the handle relative to the head, the position control feature includes a bracket that permits pivoted movement of the handle relative to the head and a portion of the handle that is arranged to selectively engage the bracket to limit or prevent pivoted movement of the handle relative to the head; and which also includes at least one post and wherein the bracket includes a slot in which said at least one post is received, and wherein the handle is connected to said bracket at the pivot spaced from the post to permit pivoted movement of the handle relative to the head, and a fastener is disposed on said at least one post and is adapted to engage the bracket to selectively limit or prevent pivoted movement of the handle.

2. The tool of claim 1 wherein the handle includes a base to which the handle is connected, said base including said at least one post and being connected to the bracket at said pivot.

3. A tool, comprising:

a handle;

a head having a planar lower surface and at least one side face inclined at an acute included angle relative to the lower surface;

a mount interconnecting the handle and the head, the mount having at least one connection feature permitting pivoted movement of the handle relative to the head to permit changes in the angle of the handle relative to the head;

wherein the connection feature includes a pivot that permits pivoted movement of the handle relative to the head and the mount includes a position control feature that selectively limits or prevents movement of the handle relative to the head;

wherein the position control feature includes a bracket with a slot, and a post coupled to the handle for movement with the handle and extending through the slot for movement along the slot; and a fastener carried by the post and moveable from a position permitting movement of the post relative to the bracket to a position at least substantially restricting movement of the post relative to the bracket to maintain the position of the post relative to the bracket.

4. The tool of claim 3 wherein the handle carries the post and is connected to the bracket at the pivot spaced from the post to permit pivoted movement of the handle about the pivot.

5. The tool of claim 4 wherein the handle includes a base to which the handle is connected, said base including said post and being connected to the bracket at said pivot.

6. The tool of claim 3 wherein the slot permits the handle to pivot more than 90 degrees.

7. The tool of claim 3 wherein the head includes at least one support that is disposed directly adjacent to a portion of a seat of the head for a bracket and is adapted to prevent movement of the bracket in the direction of the support.

8. The tool of claim 7 wherein the head includes a plurality of supports with at least one support on each of a pair of opposed sides of the bracket.

9. The tool of claim 8 wherein the supports define at least two seats adapted to receive the bracket in different positions on the head.

* * * * *